United States Patent [19]

Snyder

[11] Patent Number: 4,796,890

[45] Date of Patent: Jan. 10, 1989

[54] RANDOM NUMBER SELECTION DEVICE

[76] Inventor: Blair G. Snyder, 1405 N. 36th St., No. 2, St. Joseph, Mo. 64506

[21] Appl. No.: 23,002

[22] Filed: Mar. 6, 1987

[51] Int. Cl.[4] ..... A63F 7/04

[52] U.S. Cl. ..... 273/144 B

[58] Field of Search ..... 273/144 B

[56] References Cited

U.S. PATENT DOCUMENTS

| | | | |
|---|---|---|---|
| 914,655 | 3/1909 | Glenn . | |
| 2,103,151 | 12/1937 | Dietrich | 273/144 B X |
| 3,095,655 | 7/1963 | Berglund et al. | 35/30 |
| 4,273,335 | 6/1981 | Allonsius | 273/144 B |
| 4,385,763 | 5/1983 | Moscovich | 273/86 R |
| 4,403,775 | 9/1983 | Chaput | 273/144 B |
| 4,444,394 | 4/1984 | Pasquine | 273/144 B |
| 4,465,278 | 8/1984 | Messina et al. | 273/144 B |
| 4,497,486 | 2/1985 | Bennett | 273/144 B |
| 4,498,671 | 2/1985 | Kostow | 273/144 B |
| 4,509,755 | 4/1985 | Cheatham | 273/144 B |
| 4,530,503 | 7/1985 | Rice | 273/144 B |
| 4,545,578 | 10/1985 | Stagg, Jr. | 273/144 B |

FOREIGN PATENT DOCUMENTS

| | | | |
|---|---|---|---|
| 2255926 | 5/1974 | Fed. Rep. of Germany | 273/144 B |
| 3240494 | 5/1984 | Fed. Rep. of Germany | 273/144 B |
| 1480344 | 3/1966 | France . | |
| 7629847 | 5/1978 | France . | |
| 2399701 | 3/1979 | France . | |
| 2436614 | 4/1980 | France . | |
| 2558382 | 7/1985 | France . | |
| 7500129 | 7/1976 | Netherlands | 273/144 B |
| 121801 | 12/1917 | United Kingdom . | |
| 509562 | 7/1939 | United Kingdom . | |
| 897402 | 5/1962 | United Kingdom | 273/144 B |

*Primary Examiner*—Paul E. Shapiro

*Attorney, Agent, or Firm*—Hovey, Williams, Timmons & Collins

[57] ABSTRACT

A compact, economical, random indicia selection device is provided which allows versatility in generating sets of random numbers, for example, useful in selecting numbers for lottery games. The preferred device includes a container having a generally transparent top wall, a bottom wall having a plurality of ball-receiving cavities defined therein and enclosing sidewalls, all defining a ball-receiving compartment, and a plurality of numerical indicia-bearing balls received in the compartment which are registrable with the cavities, the number of cavities being less than the number of balls. In use, the device is shaken and balls allowed to settle in the cavities whereby the respective indicia can be viewed through the top wall in order to select a set of random numbers corresponding thereto.

4 Claims, 1 Drawing Sheet

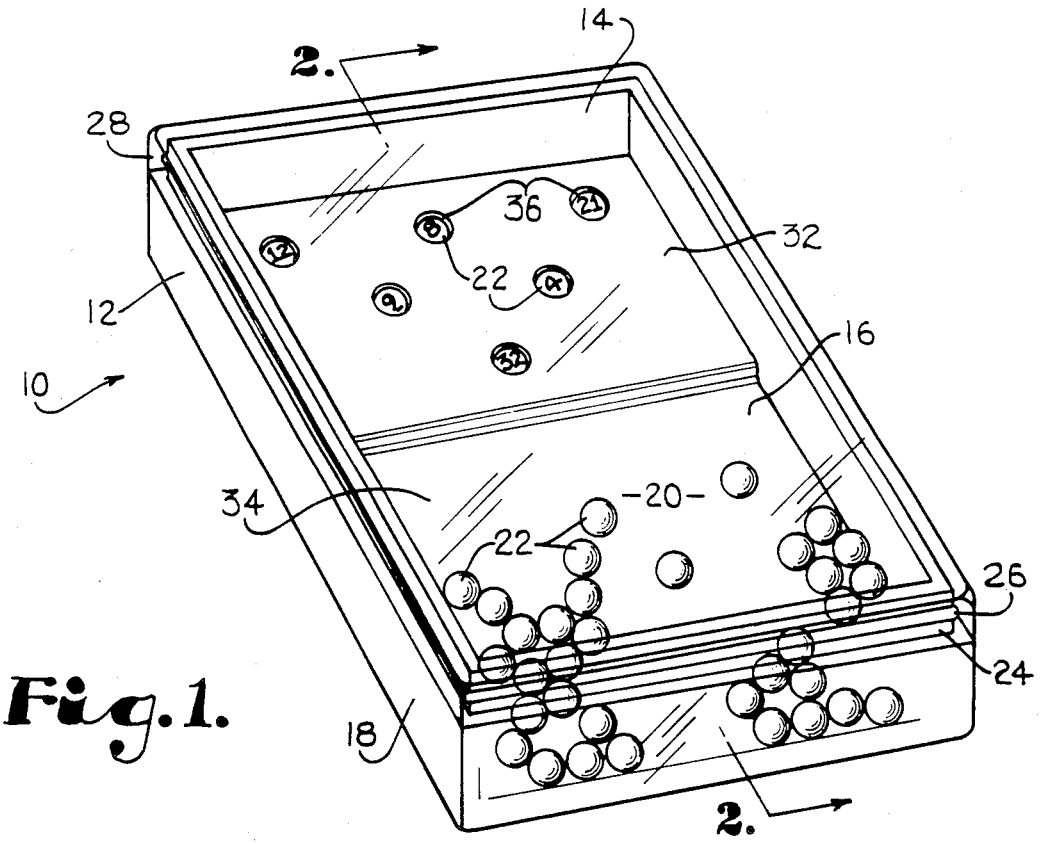
Fig. 1.
Fig. 2.
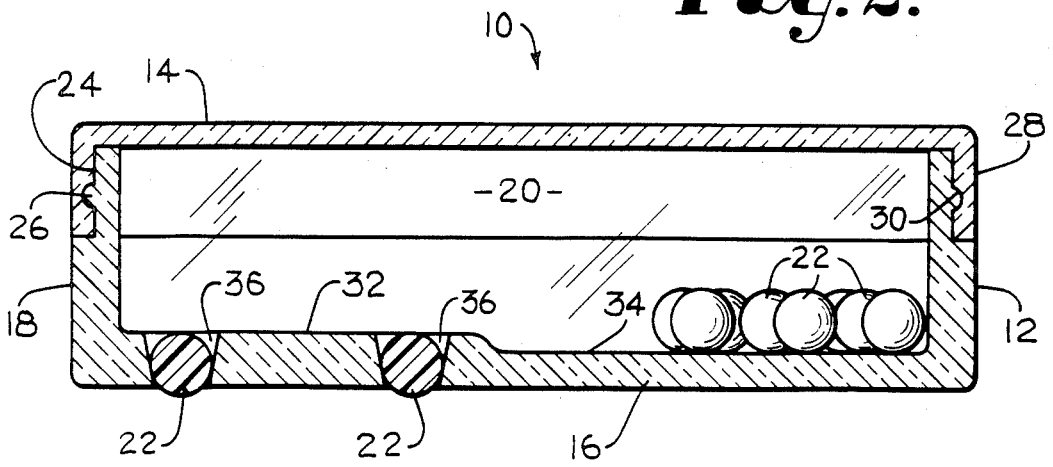

RANDOM NUMBER SELECTION DEVICE

BACKGROUND OF THE INVENTION

1. Field of the Invention

This invention relates to a compact, economical random number selection device of simple yet highly effective construction which has numerous advantages including versatility in generating different sets of random numbers useful in selecting numbers for lottery games. More particularly, it is concerned with a device having an enclosed ball-receiving compartment defined by a generally transparent top wall, a bottom wall having a plurality of ball-receiving cavities defined therein, enclosing sidewalls, and a plurality of balls received within the compartment, each bearing a respective distinct indicium thereon with the number of cavities in the bottom wall being less than the number of balls.

2. Description of the Prior Art

State-run lottery games have been very popular. One of the must popular games is known as "lotto" in which the player chooses six numbers between one and thirty-nine inclusive. The lottery officials then randomly select six numbers. The player can win varying amounts of money depending on how many of the player's numbers are selected.

Inasmuch as the official numbers for the "lotto" game are randomly generated, some players desire to likewise select their choices randomly. The prior art reveals various devices for randomly selecting numbers such as U.S. Pat. No. 4,497,486 issued to Bennett. The Bennett patent discloses a container having a plurality of indicia bearing recesses and a fewer plurality of identical balls designed for registration with the recesses. Such a device, however, requires a somewhat complex bottom wall structure in order to define the large number of recesses. This has a tendency to increase the manufacturing cost of the device. Additionally, the Bennett device does not place the balls in a given spacial pattern which somewhat inhibits the versatility of the device in selecting various random-number sets.

SUMMARY OF THE INVENTION

The problems outlined above are solved by the random number selection device in accordance with the present invention. That is to say, the present invention is compact, economical to manufacture, and allows versatility in the selection of random-number sets.

The random number selection device in accordance with the present invention broadly includes a container having a generally transparent top wall, a bottom wall, and enclosing sidewalls, the walls defining a ball-receiving compartment; and a plurality of equal-sized balls received within the compartment, each of the balls bearing a respective, distinct indicium thereon, the bottom wall including a plurality of equal-sized, ball-receiving cavities defined therein, the number of cavities being less than the number of balls, the balls being registrable within the cavities, those balls registered with the cavities and the respective indicia being viewable through the top wall, the indicia so viewed representing a random set of indicia.

Preferably, the cavities extend through the bottom wall, the balls are larger than the cavities so that the balls cannot pass therethrough, and each of the cavities are configured so that a ball received therein is accessible for external manipulation as an aid in brining the corresponding indicium into view through the top wall.

Even more particularly, the cavities are arranged in a plurality of rows with the number of cavities in a given row being different than the number of cavities in any other row. Finally, the indicia include respective sequential numbers corresponding to the number of balls.

BRIEF DESCRIPTION OF THE DRAWINGS

FIG. 1 is a perspective view of the random number selection device in accordance with the present invention; and FIG. 2 is a sectional view taken along line 2—2 of FIG. 1.

DESCRIPTION OF PREFERRED EMBODIMENT

Referring now to the drawing figures, random number selection device 10 broadly includes container 12 having a generally transparent top wall 14, a bottom wall 16, and four enclosing sidewalls 18, walls 14–18 defining a ball-receiving compartment 20 therein. Walls 16–20 are preferably composed of synthetic resin material.

Device 10 also includes thirty-nine sequentially numbered balls 22 received within compartment 20. Balls 22 are preferably composed of synthetic resin material but may be advantageously composed of aluminum or steel.

Referring now to FIG. 2, bottom wall 16 and sidewalls 18 are integrally formed with sidewalls 18 presenting a circumscribing inset portion 24 which in turn presents an outwardly extending, continuously circumscribing locking bead 26.

Top wall 14 includes a circumscribing retaining lip 28 which presents a continuous locking groove 30 on the inside surface thereof. Lip 28 and groove 30 are configured to mate respectively with inset portion 24 and locking bead 26 as shown in FIG. 2 so that top wall forms an interference fit with sidewalls 18.

Bottom wall 16 presents an upper shelf 32 and a lower shelf 34 and further includes six ball-receiving cavities 36 defined in upper shelf 32. Cavities 36 extend through bottom wall 16, present a countersunk configuration as shown in FIG. 2, and are arranged in a triangular configuration presenting three rows of cavities—the uppermost row presenting three cavities, the intermediate row presenting two cavities, and the bottom row presenting one cavity. Cavities 36 are configured so that a ball 22 received therein presents a portion thereof which extends slightly below the lower surface of bottom wall 16, the purpose of which will become clear from the discussion hereinbelow.

In use, the player shakes device 10 until balls 22 are well mixed, and then tilts device 10 forwardly so that upper shelf 32 is below the level of lower shelf 34. This action causes balls 22 to roll forwardly onto upper shelf 32 where a random six of balls 22 will occupy the six cavities 36. The user then tilts device 10 so that the balance of balls 22 roll onto lower shelf 34 thus exposing the six balls 22 occupying cavities 36 to view through transparent top wall 14. By viewing balls 22 through top wall 14, the user can select the numbers indicated on the cavity-received balls 22 as a random set of six numbers for use in playing a "lotto" game, for example.

In the event one or more individual numbers on respective balls 22 are not exposed for view through top wall 14, the player can use a finger to manipulate the lower surface portion of balls 22 extending below the bottom surface of bottom wall 16 through the cavities 36.

Device 10 provides versatility in that the row arrangement of cavities 36 presents random-number subsets of less than six numbers for playing other lottery games. For example, if only three randomly selected numbers are needed in a certain lottery game, the indicia in balls 22 received in the upper row of cavities 36 presents three such numbers. Furthermore, the present invention provides versatility in that the number of balls 22 and the number of cavities 36 and arrangement thereof can be adapted to a variety of "lotto" games requiring different numbers of balls.

The present invention can also be used for purposes other than random number selection for a lottery game or the like. For example, the indicia on balls 22 can instead be letters whereby device 10 can provide a randomly selected set of letters which can be used to play a word or spelling game.

Having thus described the preferred embodiment of the present invention what is claimed as new and desired to be secured by Letters Patent is:

1. A random indicia selection device comprising:

a container having a generally transparent top wall, a bottom wall, and enclosing side walls, said walls defining a ball-receiving compartment; and a plurality of equal-sized balls received within said compartment, each of said balls bearing a respective, distinct indicium thereon, said bottom wall including a plurality of equal-sized, ball-receiving cavities defined therein, the number of cavities being less than the number of said balls, said balls being respectively registrable within said balls, those of said balls registered in said cavities and respective indicia being viewable through said top wall, said indicia so viewed representing a random set of indicia, said cavities being arranged in a plurality of rows, each of said rows having at least one of said cavities, the number of said cavities in a given one of said rows being different than the number of said cavities in any other one of said rows.

2. A random indicia selection device comprising:

a container having a generally transparent top wall, a bottom wall having a top surface and a bottom surface, and enclosing side walls, said walls defining a ball-receiving compartment; and a plurality of equal-sized balls received within said compartment, each of said balls bearing a respective, distinct indicium thereon, said bottom wall including a plurality of equal-sized, ball-receiving cavities defined therein, the number of said cavities being less than the number of said balls, said balls being respectively registrable within said cavities, those of said balls registered with said cavities and respective indicia being viewable through said top wall, said indicia so viewed representing a random set of indicia, said cavities extending through said bottom wall, said cavities having a diameter smaller than the diameter of said balls at the bottom surface of said bottom wall but large enough to permit a portion of said balls to extend beneath the bottom surface of said bottom wall when said balls are registered in said cavities.

3. The device as set forth in claim 2, wherein said cavities are of sufficient depth that the uppermost portion of said balls registered in said cavities do not extend above a plane defined by said top surface of said bottom wall.

4. A random indicia selection device comprising:

a container having a generally transparent top wall, a bottom wall having a top surface and a bottom surface, and enclosing side walls, said walls defining a ball-receiving compartment; and a plurality of equal-sized balls received within said compartment, each of said balls bearing a respective, distinct indicium thereon, said bottom wall including a plurality of equal-sized, ball-receiving cavities defined therein, the number of said cavities being less than the number of said balls, said cavities extending through said bottom wall, said cavities being respectively registrable in said cavities, said cavities being of sufficient depth such that when said balls are registered in said cavities the uppermost portions of said balls registered in said cavities do not extend above a plane defined by said top surface of said bottom wall, those of said balls registered with said cavities and respective indicia being viewable through said top wall, said indicia so viewed representing a random set of indicia, each of said cavities being configured so that a respective one of said balls received therein is accessible for external manipulation from underneath said bottom surface as an aid in bringing corresponding indicium into view through said top wall.

* * * * *